US005862842A

United States Patent [19]

You

[11] Patent Number: 5,862,842

[45] Date of Patent: Jan. 26, 1999

[54] WORKING BENCH WITH QUICK CLAMPING TYPE CLAMP DEVICE

[76] Inventor: Yen-Jen You, 4F, No. 150, Sec. 5, Min-Sheng E. Rd., Taipei, Taiwan

[21] Appl. No.: 905,388

[22] Filed: Aug. 4, 1997

[51] Int. Cl.[6] ..... B25H 5/00

[52] U.S. Cl. ..... 144/308; 144/286.1; 144/286.5; 144/287; 269/181; 269/183; 269/204; 269/901

[58] Field of Search ..... 144/1.1, 286.1, 144/286.5, 306, 307, 308, 287; 269/172, 174, 181, 182, 183, 203, 204, 243, 257, 900, 901

[56] References Cited

U.S. PATENT DOCUMENTS

| | | | |
|---|---|---|---|
| 401,868 | 4/1889 | Townsend et al. | 144/308 |
| 543,205 | 7/1895 | Boegen | 269/183 |
| 716,805 | 12/1902 | Benedict | 144/308 |
| 1,141,237 | 6/1915 | Evans | 144/308 |
| 2,620,695 | 12/1952 | Eirman | 269/181 |
| 3,193,277 | 7/1965 | Nagamori | 269/181 |
| 3,850,422 | 11/1974 | Kwas | 269/204 |
| 4,199,135 | 4/1980 | Wohrle et al. | 269/901 |
| 4,415,149 | 11/1983 | Rees | 269/900 |
| 4,555,099 | 11/1985 | Hilton | 269/900 |
| 5,397,116 | 3/1995 | Jansen | 269/900 |

*Primary Examiner*—W. Donald Bray
*Attorney, Agent, or Firm*—Dougherty & Troxell

[57] ABSTRACT

A working bench with quick clamping type cramp device including a bench face disposed with a semicircular angle scale having a cursor and formed with multiple through holes, and a cramp device selectively fixed in the through holes of the bench face according to the size of the work piece. The cramp device includes a main base, an engaging seat opposite thereto and a quick movable clamping block positioned therebetween. A thread rod is connected with the main base and the clamping block. A ratchet crank is disposed on the thread rod. The end of the thread rod is engaged with a one-way ratchet restricting block, whereby the main base and the engaging seat are first locked in the through holes of the bench face according to the shape of the work piece and then the clamping block is quickly moved to lean against the work piece and then the ratchet crank is swung to tightly clamp the work piece.

2 Claims, 10 Drawing Sheets

WORKING BENCH WITH QUICK CLAMPING TYPE CLAMP DEVICE

BACKGROUND OF THE INVENTION

The present invention relates to a working bench with a quick clamping type cramp device including a bench face disposed with a scale and a semicircular angle scale having a cursor and a cramp device selectively fixed in the through holes of the bench face according to the size of the work piece.

A domestically used working bench has a narrow bench face and is composed of a fixed half and a movable half. A crank is disposed under the movable half, which is rotatable to drive the bench face for clamping a work piece. Such a working bench has limited area and cannot quickly and tightly clamp the work piece. Therefore, it is impractical to process a work piece on such a working bench.

SUMMARY OF THE INVENTION

It is a primary object of the present invention to provide a working bench with a quick clamping type cramp device including a bench face having wider bench face and a cramp device which is selectively fixed in the through holes of the bench face according to the size of the work piece. A clamping block can be quickly moved to abut against and quickly clamp a work piece even with an irregular shape.

It is a further object of the present invention to provide the above working bench with a one-way ratchet crank which can be quickly swung to tightly clamp the work piece at any position.

It is still a further object of the present invention to provide the above working bench in which the bench face is disposed with a scale with metric and british scales and a semicircular angle scale having a cursor, whereby the length and angle of the work piece can be easily measured during processing.

The present invention can be best understood through the following description and accompanying drawings, wherein:

DETAILED DESCRIPTION OF THE PREFERRED EMBODIMENT

Figure 1:
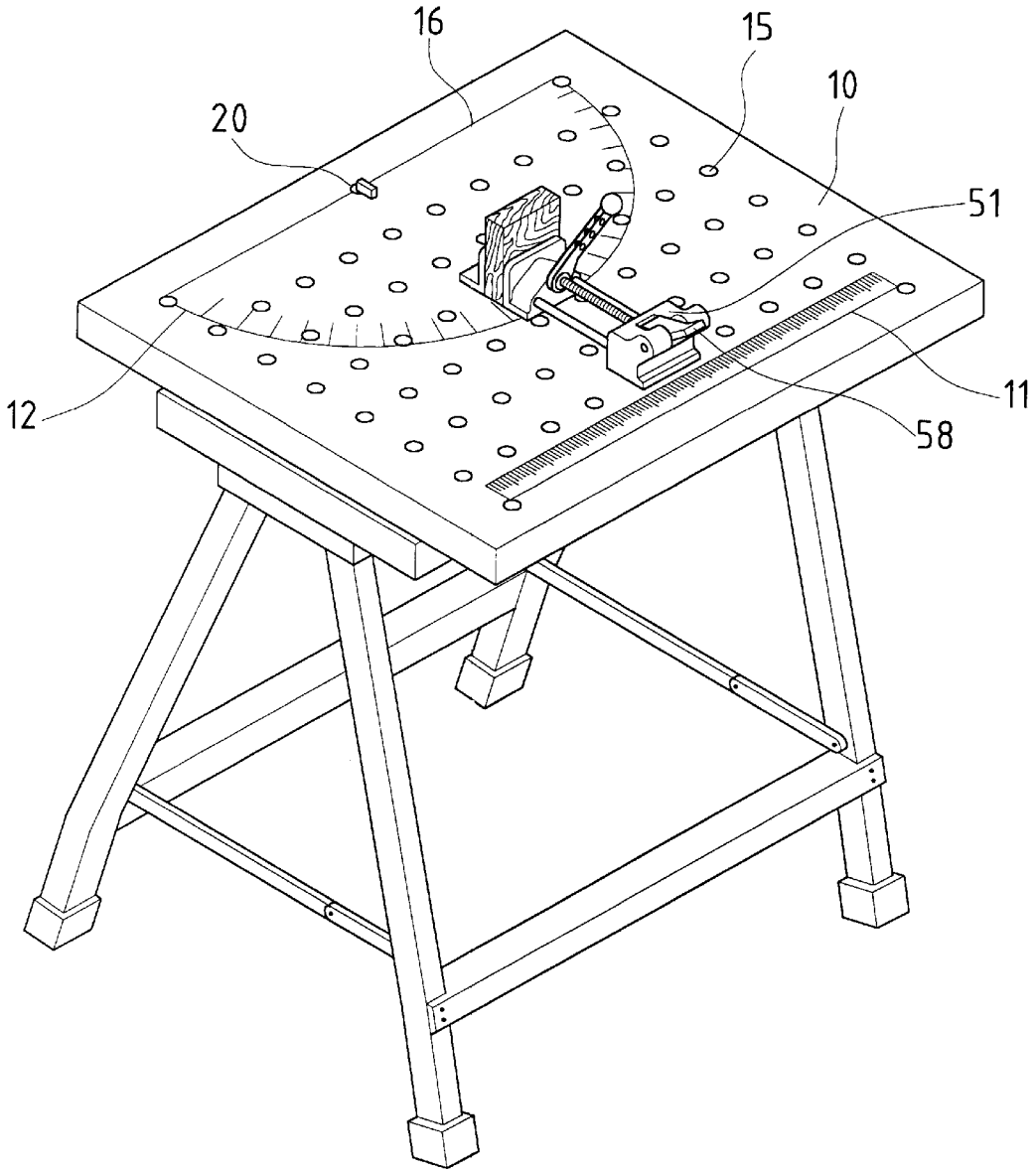
FIG. 1 is a perspective assembled view of the present invention.
Figure 2:
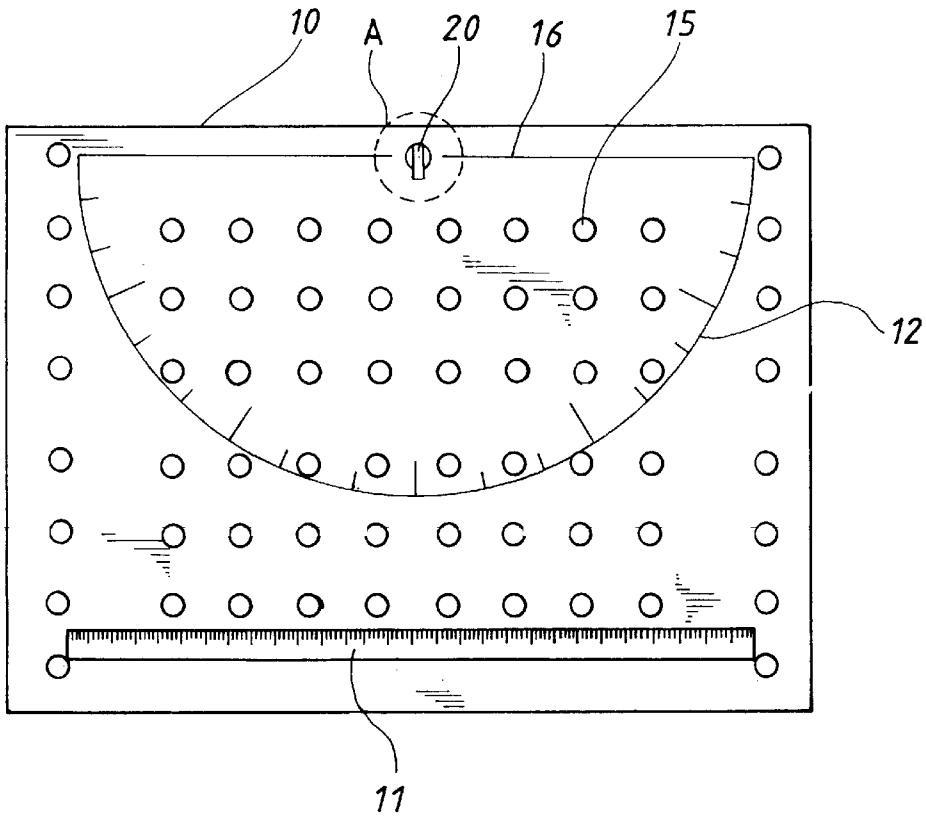
FIG. 2 is a top view of the bench face of the present invention.

Please refer to FIGS. 1 and 2. The working bench 10 of the present invention is formed with a scale 11 marked with metric and british scales at a front end. A semicircular angle scale 12 is marked opposite to the scale 11. The diameter of the angle scale 12 is substantially equal to the length of the working bench. Multiple through holes 15 are formed over the bench. A cursor 20 is disposed at the center of the horizontal line 16 passing through the center of the semicircle.

Figure 4:
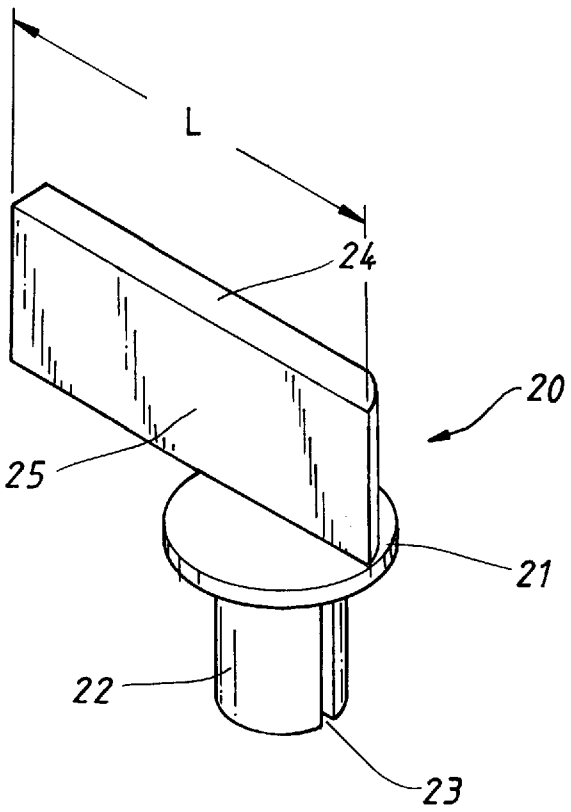
FIG. 4 is a perspective view of the cursor of FIG. 3.
Figure 3:
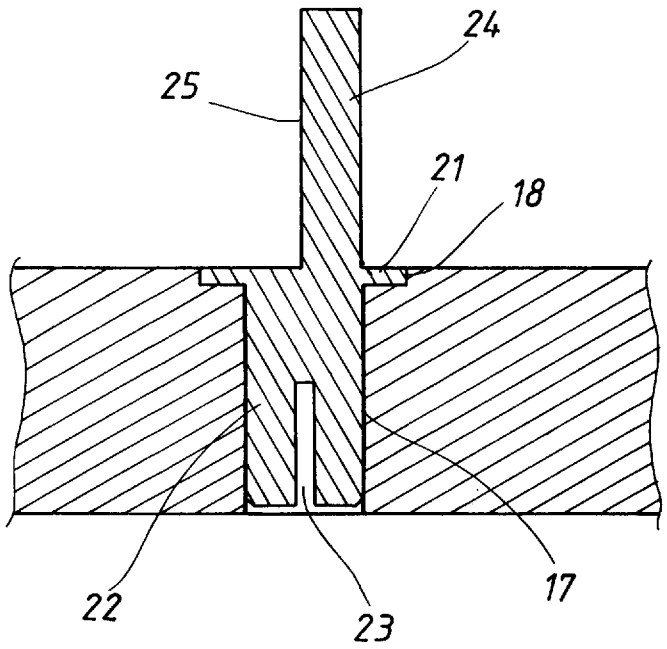
FIG. 3 is an enlarged sectional view of area A of FIG. 2.

Referring to FIGS. 3 and 4, the cursor 20 is disposed with a central disc section 21 and a rotary shaft 22 downward extending from the disc section with a thickness corresponding to that of the bench face 10. The rotary shaft 22 is disposed with a fissure 23 for increasing the tightness of insertion. A degree indicator 24 is disposed on an upper face of the disc section 21, including a plane indication face 25 extending from the central line of the disc section 21 by a certain length L. The working bench 10 is formed with a through hole 17 in which the rotary shaft 22 is inserted. The upper end of the through hole 17 is formed with an enlarged section 18 for resting the disc section 21 thereon with the degree indicator 24 above the upper surface of the working bench 10. Accordingly, one end of a work piece can lean against the indication face 25 of the degree indicator 24 with the other end rotated about the rotary shaft 22 to align with the mark of the angle scale 12 so as to measure the angle.

Figure 5:
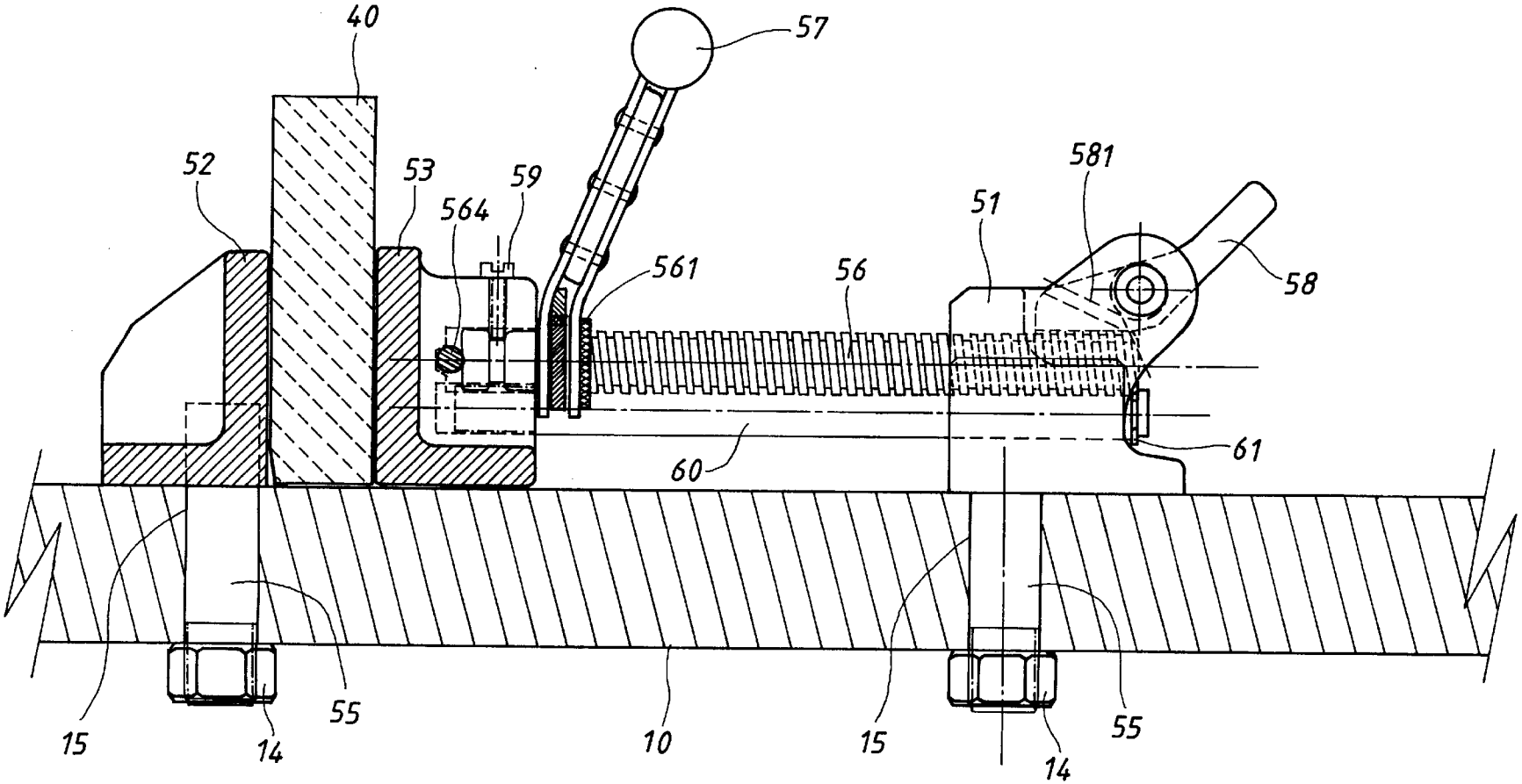
FIG. 5 is a sectional view of the cramp device of the present invention.
Figure 6:
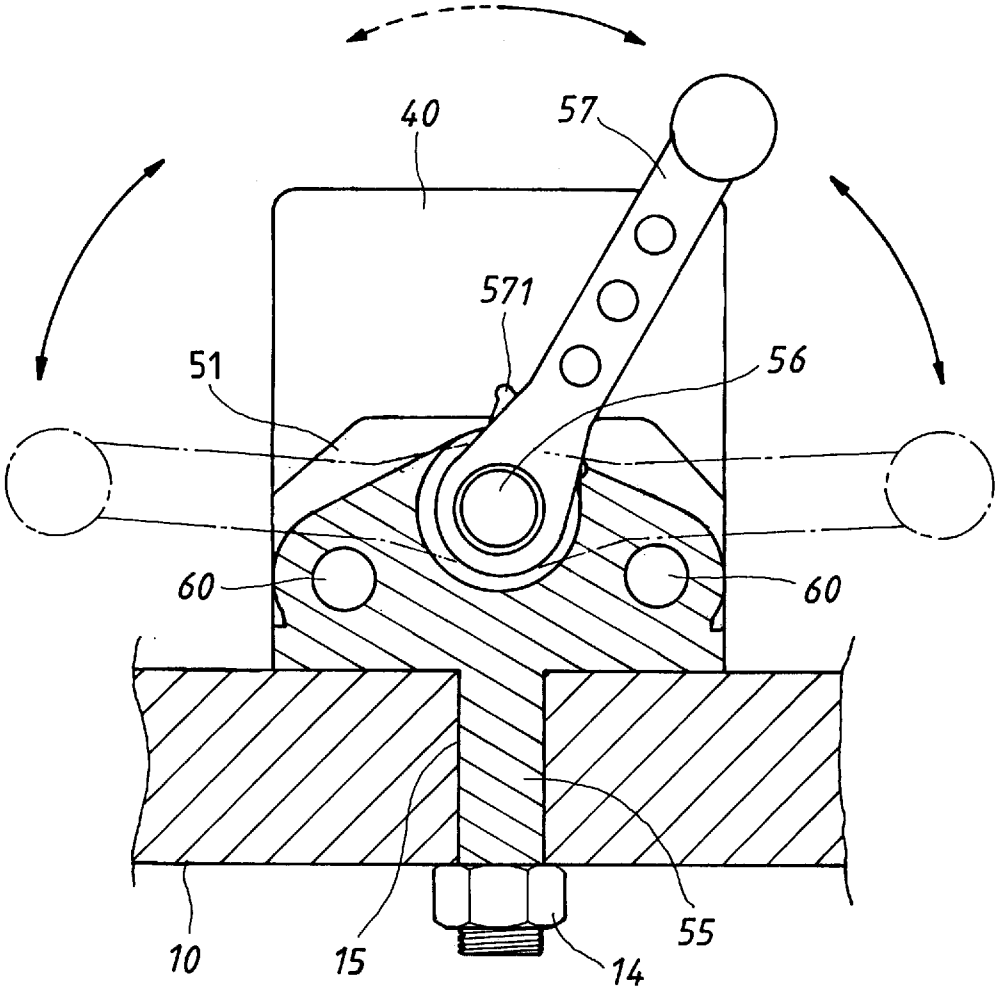
FIG. 6 shows the operation of the crank of the cramp device.

Referring to FIGS. 5 and 6, the through holes 15 of the working bench 10 are used to assemble the quick clamping type cramp device. The cramp device includes a main base 51, an engaging seat 52 opposite thereto and a quick movable clamping block 53 positioned therebetween for clamping the work piece 40. The main base 51 and the engaging seat 52 are respectively disposed with shaft rods 55 passing through the through holes 15 and tightened by nuts 14. A thread rod 56 can be passed through an inner hole of the main base 51. One end of the thread rod 56 is connected with the quick movable clamping block 53, while the other end thereof is engaged with a restricting ratchet block 58 on the main base 51.

Figure 11:
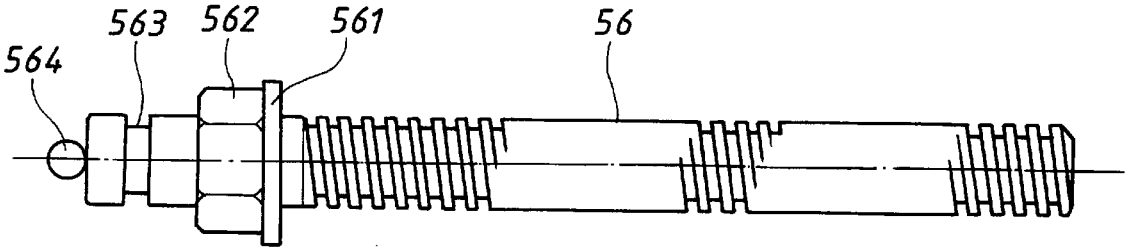
FIG. 11 is a side view of the thread rod of the present invention.

Referring to FIG. 11, the thread rod 56 has a stopper ring 561 at front end and a non-circular restricting section 562 in front of the stopper ring. A locating annular groove 563 is formed on front edge of the thread rod. When assembled with the clamping block 53, a rolling member 564 is first filled into the inner hole of the clamping block for reducing frictional force. A ratchet crank 57 is fitted with the restricting section 562. The thread rod 56 is locked by a locating screw 59 abutting against the annular groove 563.

Figure 12:
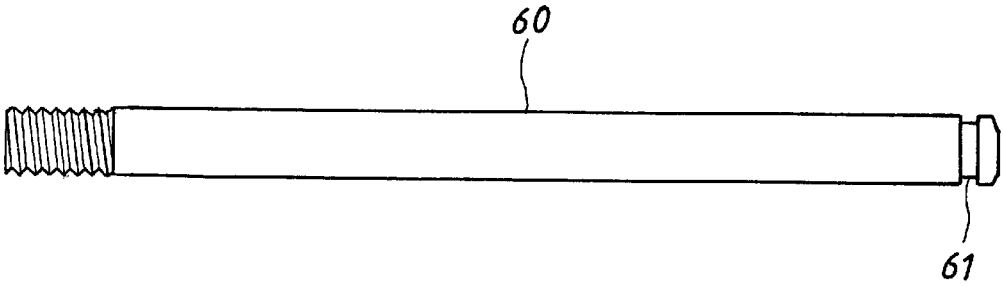
FIG. 12 is a side view of the polished guide rod of the present invention.
Figure 13A:
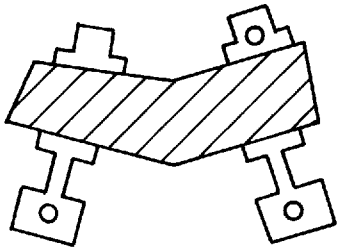
FIGS. 13A–13F show that the cramp device of the present invention is used to clamp an irregular work piece.
Figure 13B:
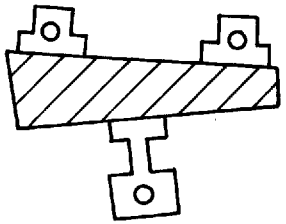
Figure 13C:
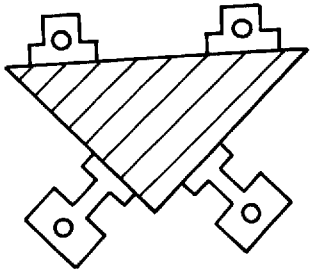
Figure 13D:
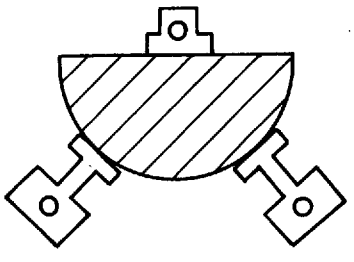
Figure 13E:
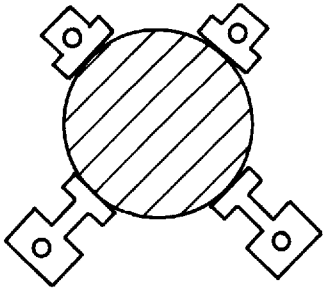
Figure 13F:
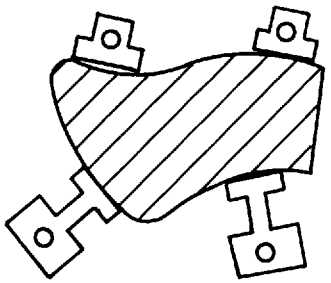

In order to stabilize the movement of the clamping block 53, the threads of front ends of two polished guide rods 60 (as shown in FIG. 12) are screwed with the clamping block 53. The guide rods are passed through the through holes in a lower end of the main base 51 and latched by C-shaped latch member 61 which also serves as stopper pad for the travel of the clamping block 53.

Referring to FIGS. 5 and 6, when clamping the work piece, the clamping block 53 is first quickly moved to lean against the work piece 40. The restricting block 58 performs a one-way restricting function, whereby after the clamping block 53 abuts against the work piece, the ratchet crank 57 only needs to be swung left and right one to two times at most less than five times to quickly tightly clamp the work piece 40 for processing.

When it is desired to release the work piece, the direction of engaging piece 571 engaged with the ratchet crank 57 is reversed. Then the crank 57 is quickly swung several times to loosen clamping block 53 and then the restricting block 58 is depressed to lift the internal spring 581 so as to release the restricting function, whereby the clamping block 53 can be quickly slided backward.

The cramp device is used on the wide bench face so as to clamp irregular work piece as shown in FIGS. 13A–13F. By means of the through holes 15 of the bench face, the main base 51 and the engaging seat 52 can be freely locked at any position.

Figure 7:
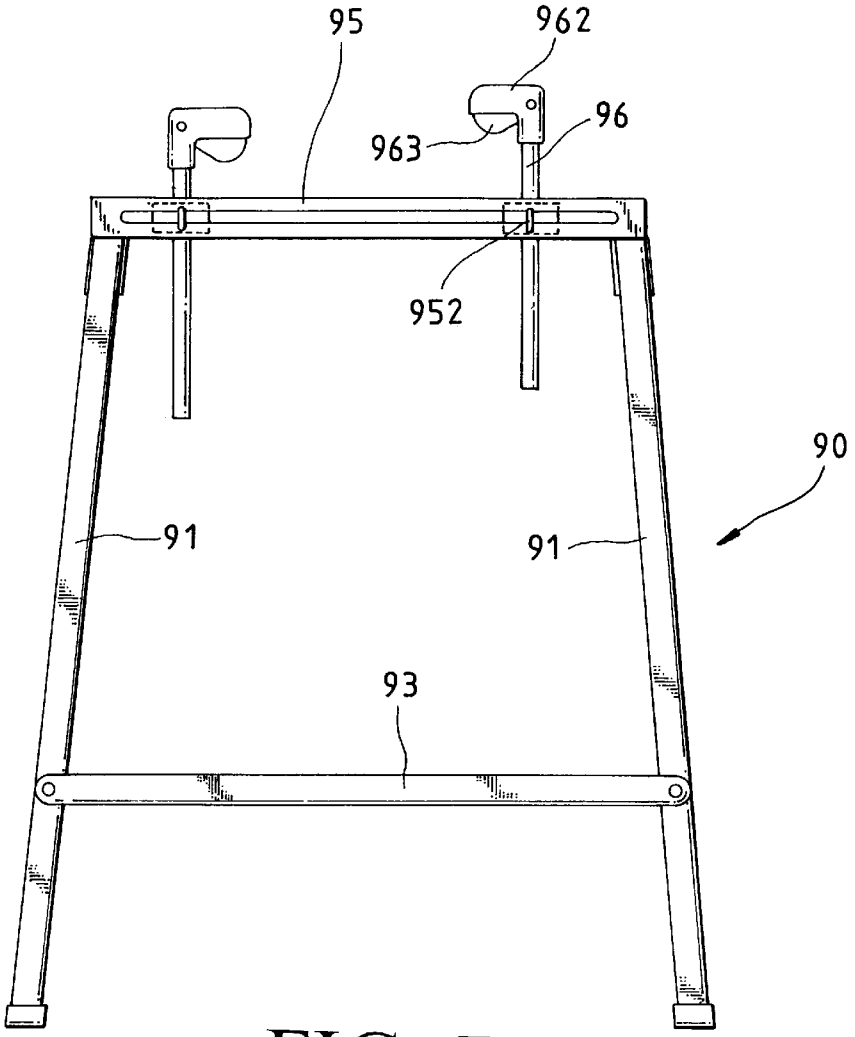
FIG. 7 is a front view of the auxiliary support of the present invention.
Figure 8:
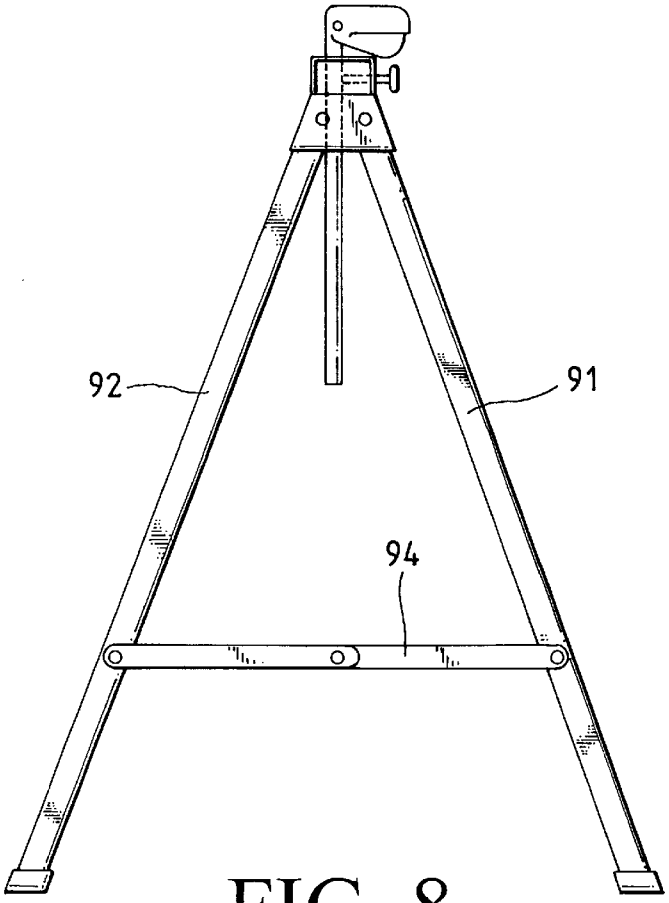
FIG. 8 is a side view according to FIG. 7.

In orde to meet the requirement of an excessively long work piece, as shown in FIGS. 7 and 8, the working bench is disposed with an auxiliary support 90. The support 90 includes front and rear inclinedly stretched support legs 91, 92 and a reinforcing beam 93 connected between the front support legs 91. A joint member 94 is disposed between the front and rear support legs for folding the same. A top beam 95 is disposed at the top ends of the lateral support legs 91, 92. Several pressing rods 96 are inserted on the top beam 95.

Figure 9:
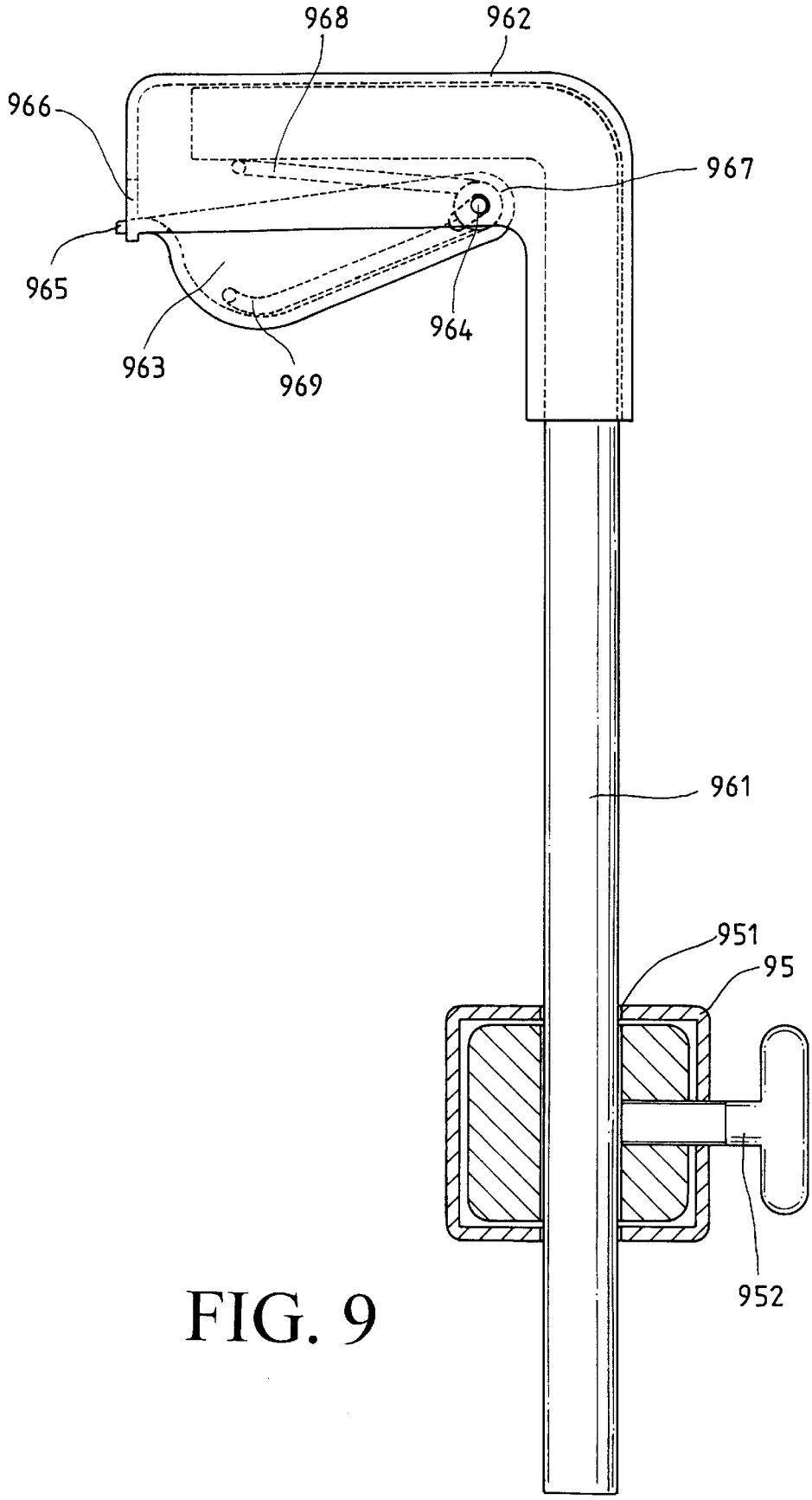
FIG. 9 is an enlarged view of the pressing rod.

As shown in FIG. 9, the pressing rod 96 has a certain length of rod body 961 passing through the through hole 951 of the top beam 95. A lateral bolt 952 is used to locate or release the pressing rod 96. The top end of the pressing rod 96 is formed with a bent tube section 962. A depressing member 963 is disposed in the bent tube section 962. One end of the depressing member 963 is pivotally connected to the bent tube section 962 with a pivot pin 964, while the other end thereof has a tongue section 965 passing through a through hole 966 of front end of the bent tube section 962. A spring 967 is fitted around the pivot pin 964. One end 968 of the spring 967 abuts against the rod body 961, while the other end 969 thereof abuts against the bottom of the depressing member 963.

Figure 10:
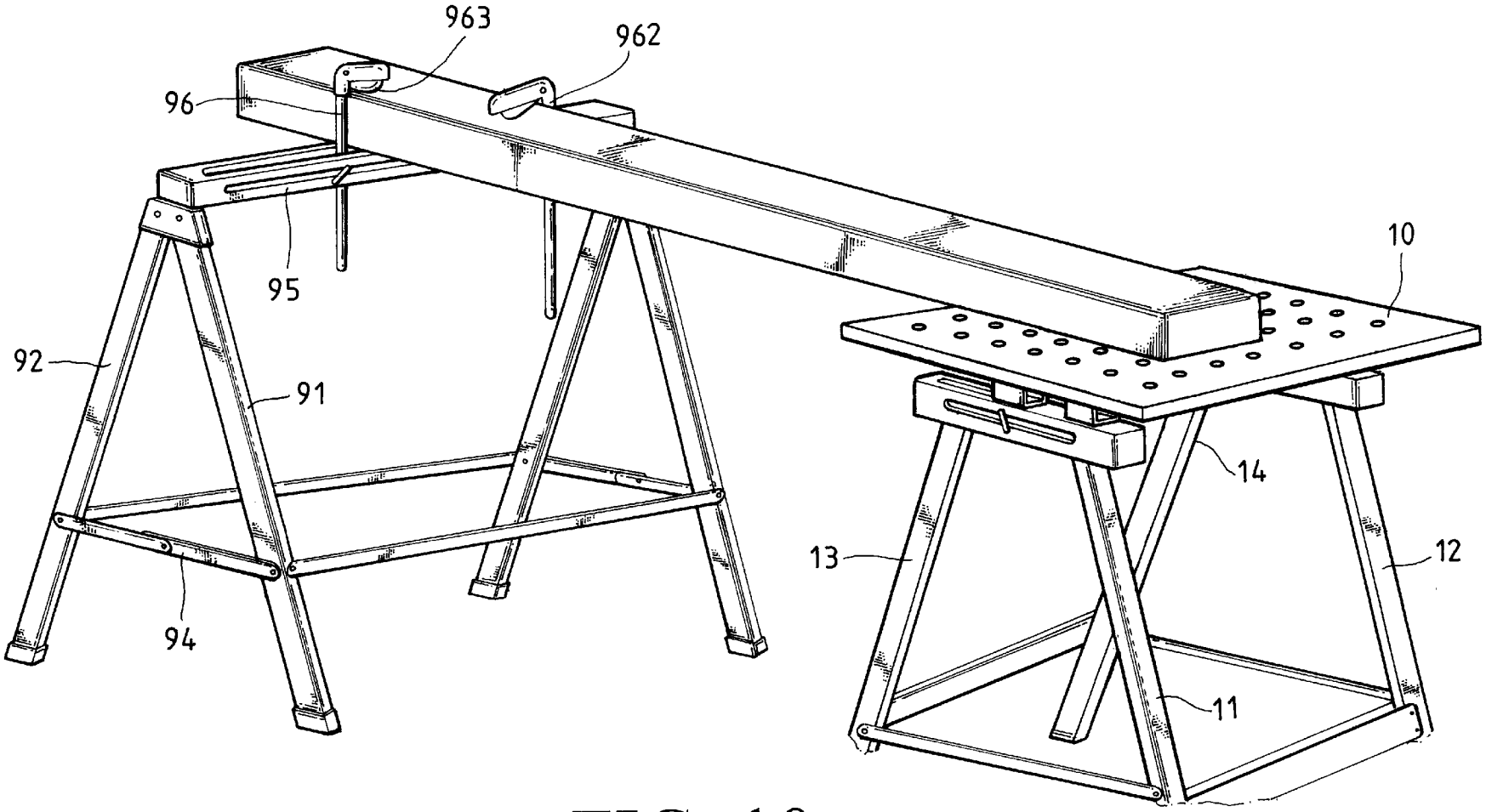
FIG. 10 shows the application of the working bench and the auxiliary support of the present invention.

The distance between the bent tube section 962 and the top beam 95 can be adjusted according to the thickness of the work piece. In addition, the depressing member 963 can be slightly retracted by external force. After released, the resilient force of the spring serves to press and locate the work piece for processing as shown in FIG. 10.

It should be noted that the above description and accompanying drawings are only used to illustrate one embodiment of the present invention, not intended to limit the scope thereof. Any modification of the embodiment should fall within the scope of the present invention.

What is claimed is:

1. A working bench with a quick clamping cramp device and comprising:

a) a working bench having a work surface and a plurality of through holes passing through the working bench and opening through the work surface, the through holes being arranged in an array extending over substantially the entire work surface;

b) a cramp device located on the working bench and having a main base with a first shaft rod selectively engageable with one of the plurality of through holes, an engaging seat having a second shaft rod selectively engageable with another of the plurality of through holes, a clamping block, and a threaded rod connected to the clamping block and to the main base;

c) a restricting block disposed between the main base and the threaded rod whereby quick movement between the threaded rod and the main base in a direction along a longitudinal axis of the threaded rod is achieved by sliding the threaded rod along the longitudinal axis, when the threaded rod is not engaged with the restricting block, and when the threaded rod is engaged with the restricting block, the restricting block permitting rotational movement of the threaded rod relative to the main base;

d) a ratchet crank arm; and, e) a ratchet mechanism disposed between the ratchet crank arm and the threaded rod whereby swinging back and forth movement of the ratchet crank arm causes rotational movement of the threaded rod only in one direction, whereby a work piece may be clamped between the engaging seat and the clamping block.

2. The working bench of claim 1 wherein the ratchet mechanism is reversible by changing an engaging direction of an engaging piece disposed in the ratchet mechanism so as to enable back and forth movement of the ratchet crank arm to selectively rotate the threaded rod in one of two opposite directions.

* * * * *